US008115701B2

(12) United States Patent
Ploquin et al.

(10) Patent No.: US 8,115,701 B2
(45) Date of Patent: Feb. 14, 2012

(54) SUSTAIN DEVICE FOR PLASMA PANEL

(75) Inventors: Didier Ploquin, Parthenay de Bretagne (FR); Philippe Marchand, Vitre (FR); Gerard Morizot, Voiron (FR)

(73) Assignee: Thomson Licensing, Boulogne-Billancourt (FR)

( * ) Notice: Subject to any disclaimer, the term of this patent is extended or adjusted under 35 U.S.C. 154(b) by 694 days.

(21) Appl. No.: 11/887,711

(22) PCT Filed: Mar. 22, 2006

(86) PCT No.: PCT/EP2006/060953

§ 371 (c)(1),
(2), (4) Date: Jan. 22, 2009

(87) PCT Pub. No.: WO2006/106043

PCT Pub. Date: Oct. 12, 2006

(65) Prior Publication Data

US 2009/0213044 A1 Aug. 27, 2009

(30) Foreign Application Priority Data

Apr. 4, 2005 (FR) ..... 05 50882
May 10, 2005 (FR) ..... 05 51210

(51) Int. Cl.
*G09G 3/28* (2006.01)

(52) U.S. Cl. ..... 345/60

(58) Field of Classification Search ..... 345/60
See application file for complete search history.

(56) References Cited

U.S. PATENT DOCUMENTS 4,496,879 A * 1/1985 Suste ..... 315/169.4
4,866,349 A * 9/1989 Weber et al. ..... 315/169.4
4,924,218 A * 5/1990 Weber et al. ..... 345/67
5,081,400 A * 1/1992 Weber et al. ..... 315/169.4
5,148,049 A * 9/1992 Okutsu et al. ..... 327/111
5,267,296 A * 11/1993 Albert ..... 378/113
5,642,018 A * 6/1997 Marcotte ..... 315/169.4
5,745,086 A * 4/1998 Weber ..... 345/63

(Continued)

FOREIGN PATENT DOCUMENTS

CN 1421838 6/2003

(Continued)

OTHER PUBLICATIONS

Search Report Dated Oct. 24, 2007.

*Primary Examiner* — Amare Mengistu
*Assistant Examiner* — Aaron M Guertin
(74) *Attorney, Agent, or Firm* — Robert D. Shedd; Jeffrey M. Navon

(57) ABSTRACT

The present invention concerns a device for generating a rectangular sustain voltage between the line scanning electrodes and the line common electrodes of luminous cells in a plasma panel. The device includes a first sustain amplifier connected to the line scanning electrode of the cells to produce the transitions of the first sustain voltage signal, and a second sustain amplifier connected to the line common electrode of the cells to produce the transitions of the second sustain voltage signal. It also includes an insulated voltage supply circuit which is connected directly to the line scanning electrodes and to the line common electrodes of the cells in order to hold the end-of-transition voltage on said line scanning electrodes and said line common electrodes.

5 Claims, 5 Drawing Sheets

U.S. PATENT DOCUMENTS

| | | | | |
|---|---|---|---|---|
| 5,828,353 | A * | 10/1998 | Kishi et al. | 345/55 |
| 5,943,030 | A * | 8/1999 | Minamibayashi | 345/60 |
| 6,373,452 | B1 * | 4/2002 | Ishii et al. | 345/67 |
| 6,538,627 | B1 * | 3/2003 | Whang et al. | 345/60 |
| 6,646,387 | B2 * | 11/2003 | Chae et al. | 315/165 |
| 6,686,912 | B1 * | 2/2004 | Kishi et al. | 345/211 |
| 6,781,322 | B2 * | 8/2004 | Onozawa et al. | 315/169.3 |
| 6,850,213 | B2 * | 2/2005 | Marcotte | 345/60 |
| 7,034,468 | B2 * | 4/2006 | Kim et al. | 315/169.4 |
| 7,081,891 | B2 * | 7/2006 | Schermerhorn | 345/211 |
| 7,084,839 | B2 * | 8/2006 | Onozawa et al. | 345/55 |
| 7,123,219 | B2 * | 10/2006 | Lee | 345/76 |
| 7,145,522 | B2 * | 12/2006 | Yamamoto et al. | 345/60 |
| 7,230,587 | B2 * | 6/2007 | Onozawa et al. | 345/60 |
| 7,242,372 | B2 * | 7/2007 | Onozawa et al. | 345/42 |
| 7,242,399 | B2 * | 7/2007 | Onozawa et al. | 345/212 |
| 2002/0122016 | A1 * | 9/2002 | Iwasa et al. | 345/60 |
| 2003/0030632 | A1 * | 2/2003 | Choi | 345/211 |
| 2004/0257304 | A1 * | 12/2004 | Yamamoto et al. | 345/60 |
| 2005/0007310 | A1 * | 1/2005 | Kim et al. | 345/60 |
| 2005/0088376 | A1 * | 4/2005 | Inoue et al. | 345/60 |
| 2005/0140592 | A1 | 6/2005 | Gagnot | |

FOREIGN PATENT DOCUMENTS

| | | |
|---|---|---|
| EP | 1318593 | 6/2003 |
| JP | 2004/361959 | 12/2004 |
| WO | WO 03/073406 | 9/2003 |

* cited by examiner

SUSTAIN DEVICE FOR PLASMA PANEL

This application claims the benefit, under 35 U.S.C §365 of International Application PCT/EP2006/060953, filed Mar. 22, 2006, which was published in accordance with PCT Article 21 (2) on Oct. 12, 2006 in English and which claims the benefit of French patent application No. 0550882, filed Apr. 4, 2005 and French patent application No. 0551210, filed May 10, 2005.

The present invention concerns a device for generating a rectangular sustain voltage between the line scanning electrodes and the line common electrodes of luminous cells in a plasma panel.

Conventionally, a plasma display panel has a plurality of cells arranged in rows and columns. In the coplanar technology currently employed, each cell has three electrodes:

- one electrode called the "column electrode" used mainly for addressing the cells; the column electrodes of all the cells in the panel are connected to a column driver circuit; and
- two row electrodes, one of which is called a "line scanning electrode" and used to individually address each row of cells, while the other one is called a "line common electrode"; all the line scanning electrodes are connected, on one side of the panel, to a row driver circuit and the line common electrodes are interconnected on the other side of the panel.

In this type of panel, the addressing of a cell involves applying a specific high-voltage signal between its line scanning electrode and its column electrode to modify its charge state. At the end of the addressing operation, the cell can have two charge states: a first state called "excited" which will enable it to be lit during the cell sustain phase to follow and a second state in which it will remain off. The sustain phase of the cells that follows the addressing phase is a period during which high-voltage rectangular signals are applied to the line scanning electrodes and the line common electrodes. During this phase, the cells excited beforehand light up.

To generate such voltage signals, the display panel has power amplifiers. The panel includes in particular a column amplifier to generate the addressing signal to apply to the column electrode of the cells and a sustain amplifier to generate the sustain signal applied to the line scanning electrode and the line common electrode of the cells.

These amplifiers have in common the need to generate signals having high-voltage transitions at high frequency on a very high capacitive load equal to the equivalent capacitance of all the cells in the panel or to the capacitance of a large number of them.

The sustain operation of the cells therefore involves an enormous transfer of energy between the amplifier and the panel cells, and this must be recovered. The same applies to the operation for addressing columns of cells.

To this end, a sustain amplifier with energy recovery, called a "Weber" amplifier, named after its inventor, was developed. FIG. 1 represents the architecture of the power electronics of a plasma panel from its mains power supply to the plasma panel. The first power stage 1 is an AC/DC converter with power factor correction. This stage is connected to the mains supply. Its role is to adapt the current from the mains so that it has a sinusoidal waveform that is synchronous with the voltage waveform. This stage is well known to the person skilled in the art. It includes a diode bridge D1 to D4 to convert sinusoidal voltage to a DC voltage, an inductor L1 with a switch T1 in series with it connected to the terminals of the diode bridge to drive the current as described while adjusting the value of the DC voltage at the output, a rectifier diode D5 and a high-value electrolytic capacitor Cc at its output terminals. The next stage is a DC/DC converter 2 responsible for delivering a high-value regulated voltage for the sustain operation of the plasma panel cells. The regulated voltage is delivered to the row sustain amplifier of the plasma panel. As represented in FIG. 1, this row sustain amplifier actually includes two identical amplifiers, one of them 11 intended to supply the line scanning electrode Y of the cells via a row driver circuit 12 and the other 13 intended to supply their line common electrodes Z. The plasma panel cells are represented in the figure by their equivalent capacitance Cp. This equivalent capacitance is in practice made up of the capacitance Cp1 present between the line scanning electrodes Y and the line common electrodes Z of the panel, the capacitance Cp2 present between the line scanning electrodes Y and the column electrodes of the panel and lastly the capacitance Cp3 present between the line common electrodes Z and the column electrodes of the panel. An addressing voltage generator 15 is also provided to produce the appropriate voltages to apply to the electrodes of the cells in order to address them. The row driver circuit 12 is for selecting the voltage to apply to the Y electrode of the cells. Likewise, a column driver circuit 14 selects the voltage to apply to the column electrode of the cells.

The amplifier 11 intended to supply the Y electrodes conventionally includes switches M1 and M2, connected in a half-bridge structure, placed in series between a supply terminal receiving the very high sustain voltage VS delivered by the DC/DC converter 2 and a reference terminal (connected here to ground GND). These switches are controlled so as to generate on the Y electrode of the panel cells a rectangular signal alternating between the voltage VS and the potential present on the reference terminal. As represented in the figure, these switches are generally MOS transistors with their diodes in anti-parallel. To recover and re-inject the capacitive energy and produce soft switching between the voltage VS and ground, the amplifier 11 includes a resonant inductor L placed in series with a switching module MC and a storage capacitor C1. These three components are connected between the Y electrode and the reference potential. The switching module includes two current conduction paths arranged in parallel, each allowing current to flow in one direction. The first current path includes a switch M3 placed in series with a diode D3 to allow the current to flow towards the storage capacitor C1 when the switch M3 is closed and thus to produce the falling edge of the output signal of the amplifier. The second current path includes a switch M4 placed in series with a diode D4 to allow the current to flow towards the resonant inductor L when the switch M4 is closed and thus to produce the rising edge of the output signal.

As regards the amplifier 13, it includes the same components as the amplifier 11 which are connected in the same way between the line common electrode Z and the reference terminal. To differentiate hereafter in the present description between the components of the amplifier 11 and those of the amplifier 13, the components M1, M2, L, MC, M3, M4, D3, D4 and C1 of the amplifier 11 are labelled M1', M2', L', MC', M3', M4', D3', D4' and C1' in the amplifier 13.

FIG. 2 represents the sustain voltage signals to be generated on the Y and Z electrodes and the resulting voltage across the terminals of the panel cells according to a well-known operating mode to achieve good sustaining of electrical discharges in the cells. According to this operating mode, the transitions of the voltage generated on the Y electrode are synchronized with those of the voltage generated on the Z electrode in order that the voltage across the terminals of the panel cells alternates continuously between +VS and −VS.

This operating mode is given only by way of example to understand how the Weber circuit operates. Of course, there are other operating modes, in particular a mode in which the voltage transitions on the Y electrode of the cells are offset with respect to those on the Z electrode.

To obtain one or other of the voltage signals shown in FIG. 2, the amplifiers 11 and 13 are controlled as illustrated in FIG. 3. This figure represents more specifically the voltages for controlling switches M1 to M4, the resulting output voltage of the amplifier and the current iL flowing through the resonant inductor L. In this figure, it is considered that, in the initial state, the switches M2, M3 and M4 are open and the switch M1 is closed. The voltage on the Y electrode is therefore equal to VS. After opening of the switch M1 then closure of the switch M3, the voltage on the Y electrode starts to fall. During this phase, the resonant circuit formed by the inductor L and the equivalent capacitance Cp is closed by the diode D3, the switch M3 and the storage capacitor C1 with the following initial conditions:

the current iL through the inductor L is 0, the voltage on the Y electrode is equal to VS, and the voltage across the storage capacitor terminals is equal to VS/2.

Since the value of the storage capacitor C1 is much greater than that of the capacitance Cp, the voltage across its terminals can be considered to be constant and equal to VS/2. As the current through the inductor L increases, the output of the amplifier and the voltage across the terminals of the capacitance Cp decreases according to a sinusoidal segment until the voltage on the Y electrode reaches VS/2 (point where the current iL stops increasing). This first phase corresponds to a transfer of energy from the capacitance Cp to the inductor L. A transfer in the opposite direction occurs during the next phase: during that phase, the current iL decreases and the voltage on the Y electrode continues to decrease according to another sinusoidal segment until it reaches 0 volts (the reference potential). The diode D3 prevents the current from flowing in the other direction. Closure of the switch M2 then enables the voltage on the Y electrode to be held at 0 volts. The transition from 0 volts to VS of the voltage on the Y electrode is achieved in the same way by the closure of the switch M4.

During the transition phases of the voltage across the terminals of the cells, significant energy transfers take place between the inductor L and the capacitance Cp. High charge currents and currents related to the electrical discharges in the plasma gas of the cells at the ends of transitions flow through the amplifier. These currents have very high values, in the order of several tens of amperes, over very short time intervals of about 1 microsecond. To this end, the storage capacitors C1, C1' and Cc must be connected perfectly to the other components of the amplifiers and to the panel in order to reduce the parasitic inductances and to not modify the waveforms of the voltages applied to the electrodes of the cells and the overall behaviour of the panel in terms light emission.

The invention proposes a novel plasma panel sustain circuit architecture without a DC/DC converter at the output of the AC/DC converter with power factor correction, the aim being to supply the power as close as possible to the panel cells.

The invention concerns a device for generating a rectangular sustain voltage between the line scanning electrodes and the line common electrodes of luminous cells in a plasma panel, said voltage being produced by applying a first rectangular sustain voltage signal to the line scanning electrode of the cells and a second rectangular sustain voltage signal to the line common electrode of the cells, characterized in that it includes a first sustain amplifier connected to the line scanning electrode of the cells to produce the transitions of the first sustain voltage signal, a second sustain amplifier connected to the line common electrode of the cells to produce the transitions of the second sustain voltage signal and an insulated voltage supply circuit connected to the line scanning electrodes and to the line common electrodes of the cells in order to hold the end-of-transition voltage on said line scanning electrodes and said line common electrodes.

The insulated voltage supply circuit includes a transformer, the secondary of which is connected via a first end to the line scanning electrode of the cells and via a second end to the line common electrode of the cells, and a device capable of delivering to the primary of said transformer, in addition to the signal transitions, voltages corresponding to the end-of-transition voltages divided by the transformation ratio of the transformer.

The invention will be better understood on reading the following description, given by way of non-limiting example and with reference to the accompanying drawings in which:

FIG. 1, already described, is a circuit diagram of the power electronics of a plasma panel of the prior art, FIG. 2, already described, shows timing diagrams illustrating the voltage signals generated by sustain amplifiers in the circuit of FIG. 1 according to a known operating mode of the amplifier, FIG. 3, already described, shows control signals illustrating the operating mode of each of the sustain amplifiers in the circuit of FIG. 1;

Figure 1:
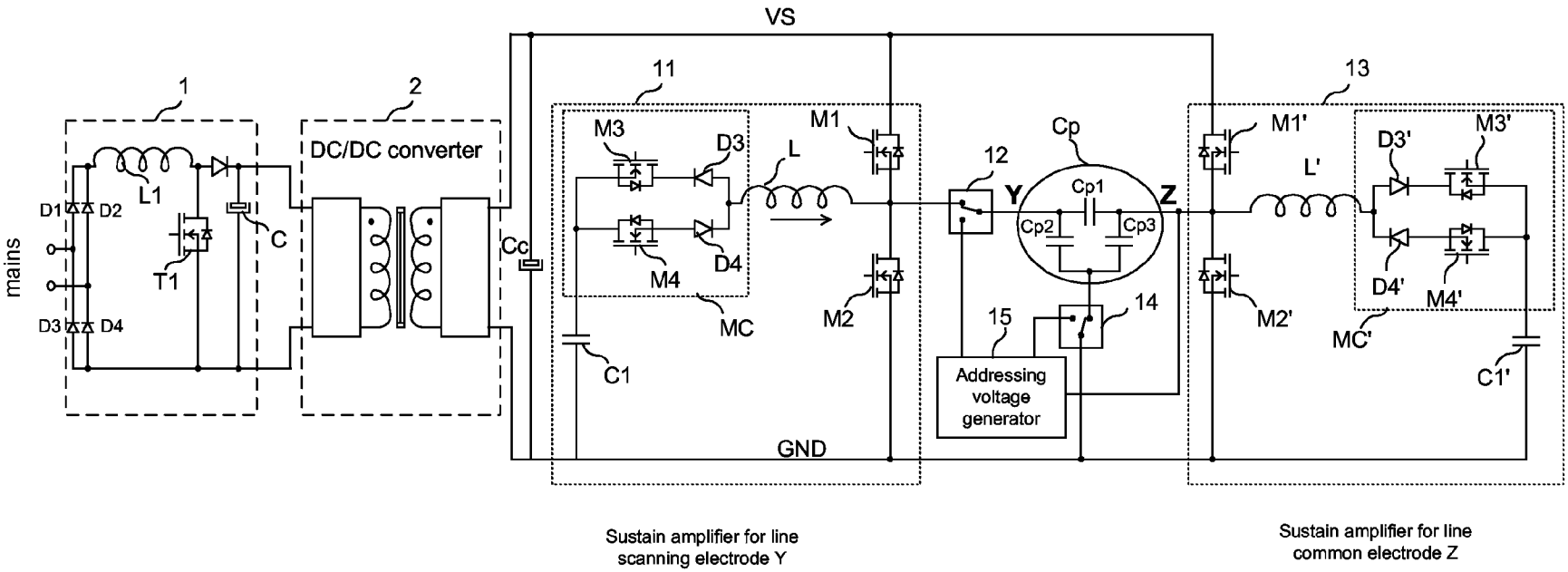
FIG.1 (prior art)

According to the invention, the DC/DC converter 2 is replaced by an insulation transformer Trf with a full-bridge structure connected to the transformer primary. The full bridge is fed by the output of the AC/DC converter with power factor correction 1 and the transformer secondary is connected directly to the outputs of the sustain amplifiers 11 and 13.

The full-bridge structure is made up of four switches M5 to M8, the switches M5 and M8 being placed in series between the two output terminals of the AC/DC converter 1 as are the switches M6 and M7. The primary winding of the transformer Trf is connected between the middle points of the bridge and, as indicated above, the secondary winding of the transformer Trf is connected directly to the outputs of the sustain amplifiers 11 and 13.

Advantageously, diodes D5 to D8 and D5' to D8' are added to the full bridge structure to manage the reverse recovery effects of the MOSFET intrinsic diodes of the switches M5 to M8 as it will be described further.

Insulation transistors M10 and M11 are connected between the output of the amplifier 11 and the row circuit driver 12. A storage capacitor Cs having a capacitance much greater than Cp is placed in parallel with the half-bridge circuits M1, M2 and M1', M2'.

During the sustain operations, the Y electrode of the cells is connected to the output of the amplifier 11 and their column electrodes are connected to ground. The insulation transistors M10 and M11 are conducting. During these operations, the voltage VS is the sustain voltage of the cells, in the order of 200 volts.

Figure 2:
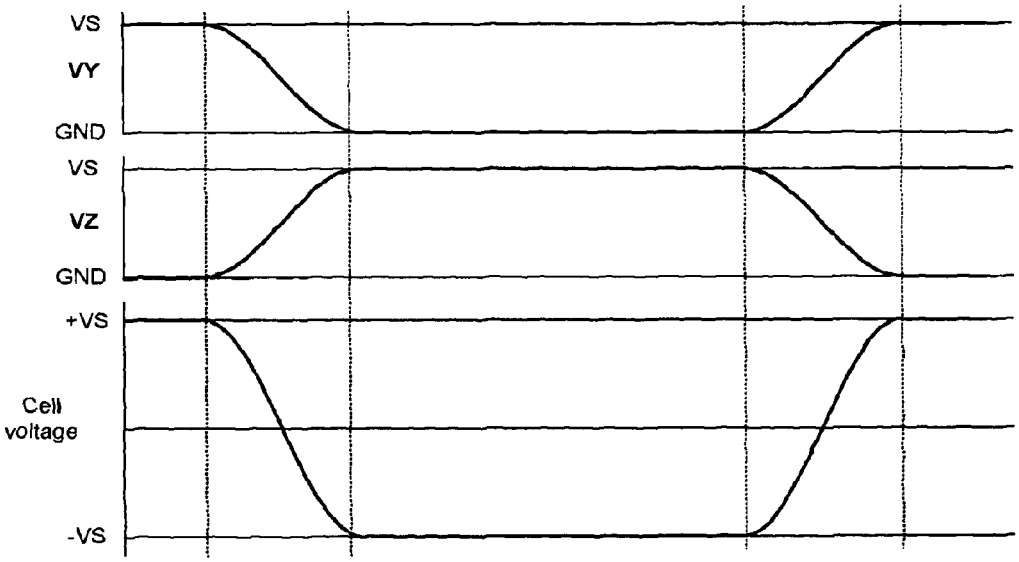
Prior Art FIG.2

During the transitions of the sustain signal applied to the cells, the switches M5 to M8 are in a high-impedance state. Except for parasitic capacitances and inductances, the connection of the secondary of the transformer Trf to the amplifiers 11 and 13 has no effect on the operation of the amplifiers and may be considered as open. Generation of signals VY and VZ applied to the electrodes Y and Z respectively of the cells is managed by the switches M1 to M4 and M1' to M4'. The capacitance Cp seen from the Y electrode is actually different to that seen from the Z electrode. For example, in the case of a synchronized transition mode as that illustrated in FIG. 2, the capacitance Cp is equal to:

for the Y electrode, the equivalent capacitance of capacitances Cp2 and $$\frac{Cp1}{2},$$

and for the Z electrode, the equivalent capacitance of capacitances Cp3 and $$\frac{Cp1}{2}.$$

Figure 3:
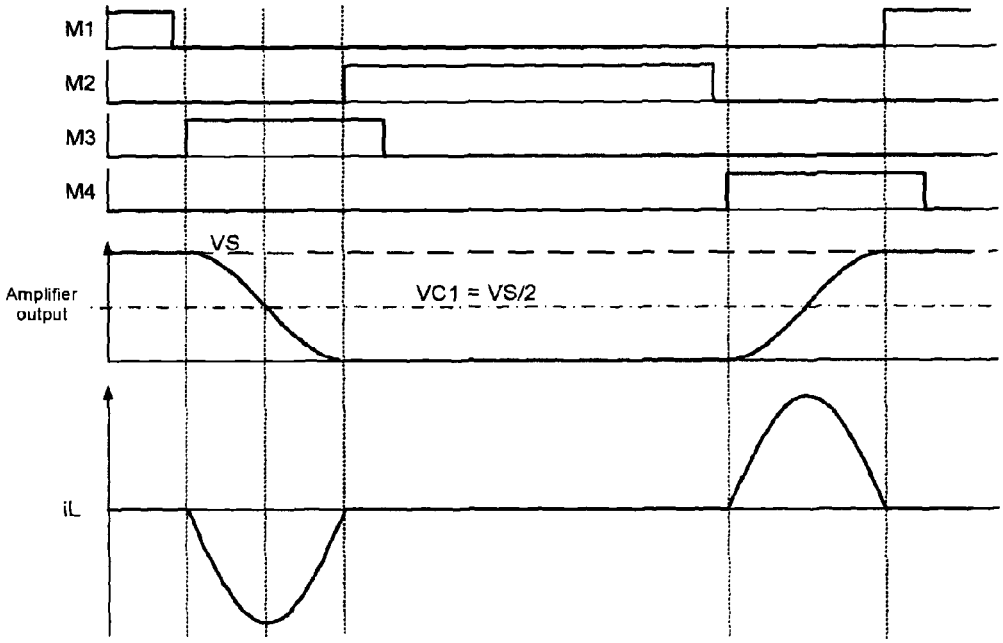
Prior Art FIG.3
Figure 4:
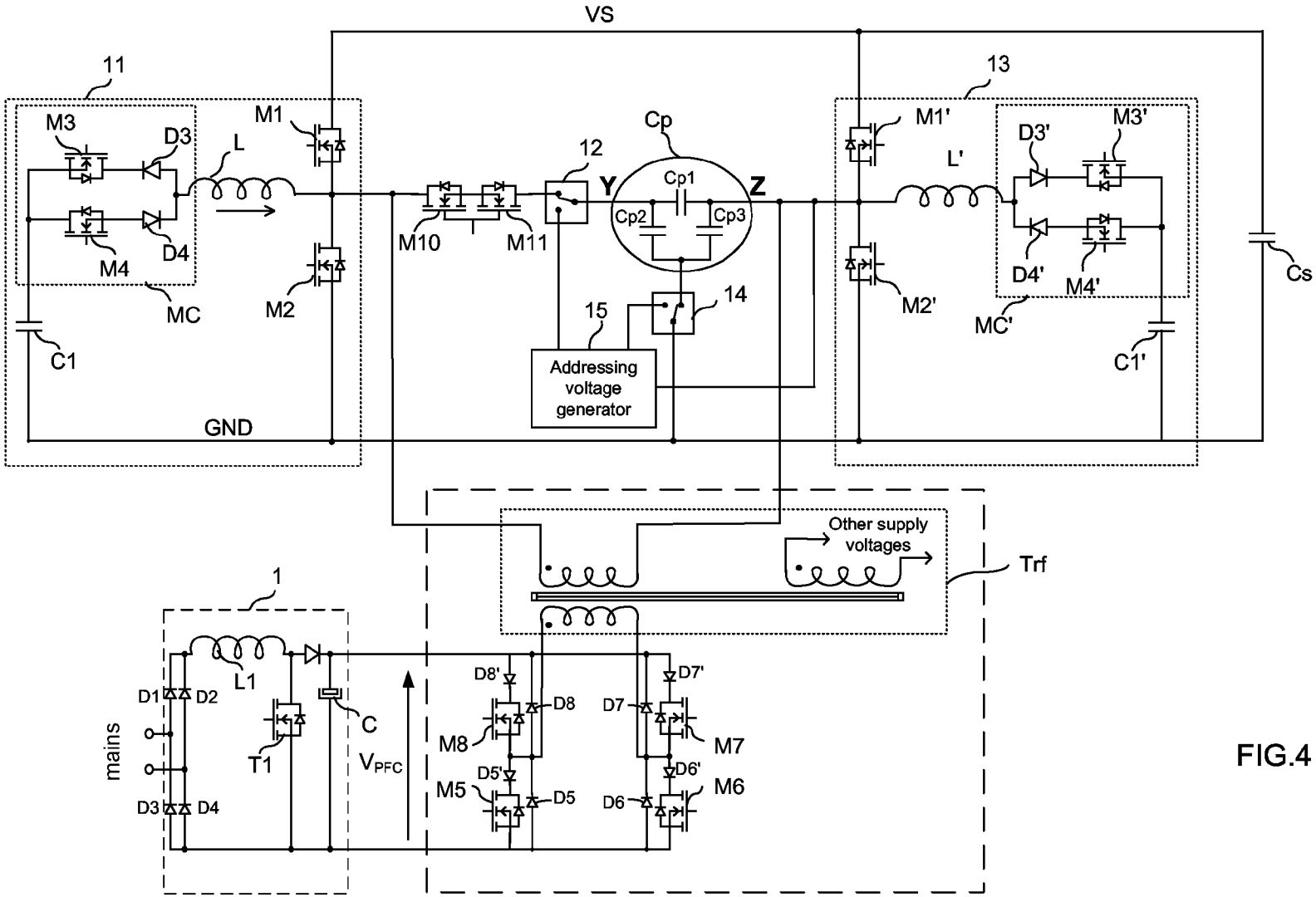
FIG. 4 shows a circuit diagram of the power electronics of a plasma panel according to a first embodiment of the invention.

On the line scanning electrode Y side, the switches M1 to M4 manage the resonance of the inductor L with the panel capacitance Cp seen from the Y electrode as illustrated in FIG. 3. Likewise, on the line common electrode Z side, the switches M1' to M4' manage the resonance of the inductor L' with the panel capacitance Cp seen from the Z electrode. The energy required to compensate for the losses in the energy recovery circuits and the losses brought about by the electrical discharges is supplied by the storage capacitor Cs.

As soon as the transitions have terminated and during the voltage plateaus, the switches M5 and M7, or M6 and M8, are made conducting depending on whether the voltage to be delivered at the output of the sustain amplifiers 11 and 13 is negative or positive. The AC/DC converter 1 delivers the voltage $V_{PFC}$. It is to be noted that the switching of the MOSFET transistors M5 to M8 is performed at zero voltage and therefore without switching losses since the voltage +VS or −VS at the transformer secondary has been reached beforehand by the output of the amplifiers 11 and 13 and brought back at the primary to $+V_{PFC}$ or $-V_{PFC}$ by the transformer Trf. The switches M1 and M2' are also made conducting during this phase such that the capacitor Cs is recharged to the voltage VS. In the present case, the leakage inductance of the transformer Trf contributes to limiting the current between the AC/DC converter and the capacitor Cs when it is recharging. This effect of current limitation is compensated by using a transformation ratio n of the transformer Trf greater than $VS/V_{PFC}$. This leakage current grows during the plateaus of the voltage applied to cells during the sustain phase. At the opening of the switches M5 and M7 (respectively M6 and M8) which correspond to the beginning of a transition, this current will flow through the intrinsic diodes of the switches M6 and M8 (respectively M5 and M7). The reverse recovery effects of the MOSFET intrinsic diodes of the switches requires to shunt the current by diodes D5 to D8 and to stop the current flowing in the Switches by the diodes D5' to D8'.

The voltage VS is advantageously regulated for compensating the power variations due the variations of the picture load in the panel by modulating the power amounts transferred from the voltage $V_{PFC}$ to the voltage VS as described before. A classical Pulse Width Modulation (PWM) method applied to the conduction time of the switches M5 and M7 (or M6 and M8) can be used within the plateau phases. However, as these conduction times are very short and consequently uneasy to control, a regulation mode using constant conduction times is preferably used. In this mode called burst mode, the power transferred during the plateau phases is always maximum but the presence or deletion of these conduction events is controlled as a function of the voltage Vs.

This structure also provides for simplifying the generation of other voltages, for example for the addressing voltage generator, by multiplying the number of windings on the secondary of the transformer Trf and by providing means of rectification, filtering and regulation to adjust the voltage to the desired value.

During the addressing phases, the insulation transistors M10 and M11 are in a high-impedance state, thus insulating the addressing voltage generator 15 from the sustain amplifiers 11 and 13. The output of the transformer is held at zero by closing the transistors M7 and M8 or M5 and M6.

Figure 5:
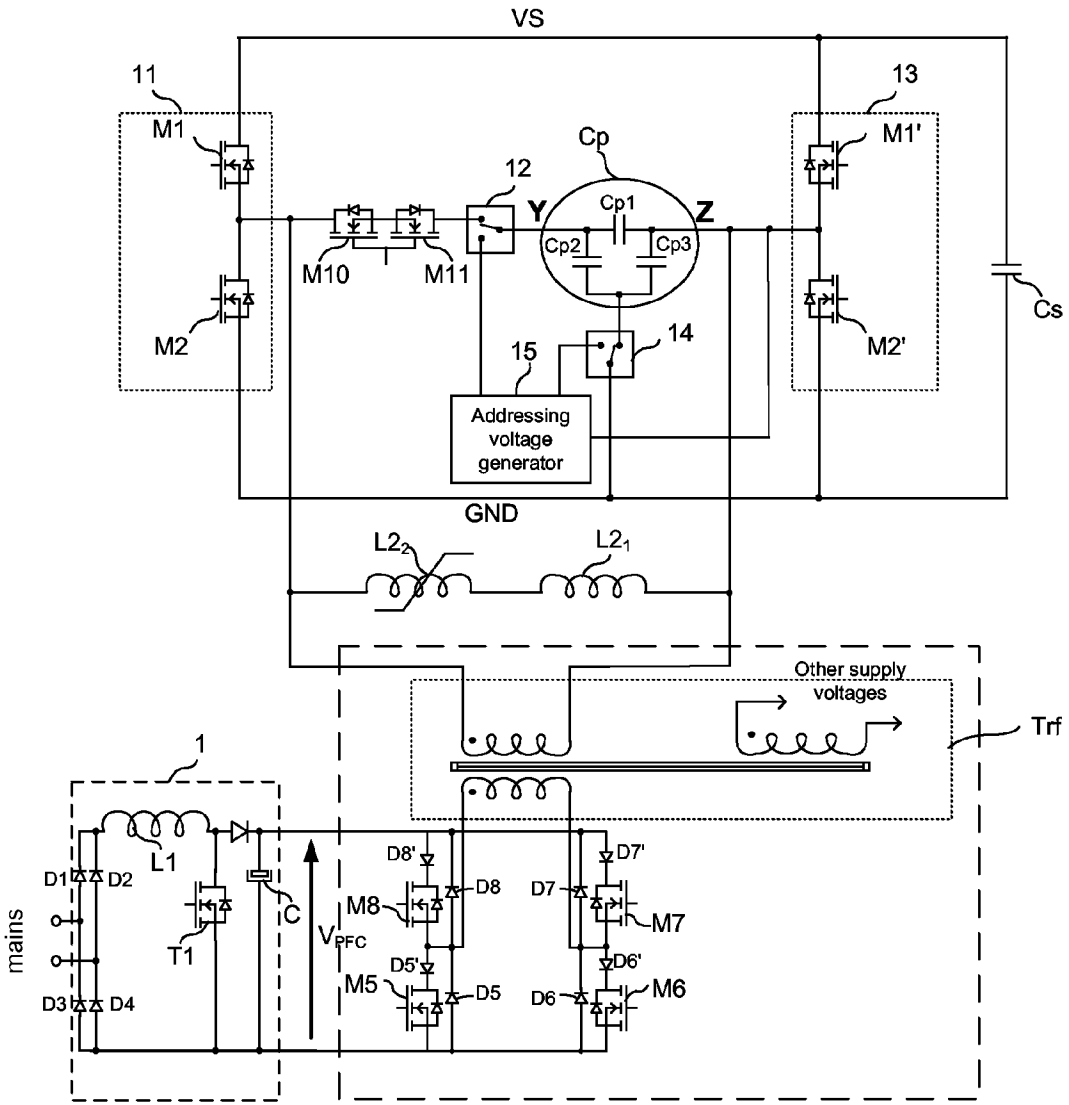
FIG. 5 shows a circuit diagram of the power electronics of a plasma panel according to a second embodiment of the invention.

A second embodiment of the device of the invention is proposed with reference to FIG. 5. The energy recovery circuit, i.e. the switching module MC or MC' and the inductor L or L', is removed in the each of the sustain amplifiers 11 and 13 and a high-value inductor $L2_2$ operating in saturated mode possibly with a conventional low-value inductor $L2_1$ in series is connected between the outputs of the two amplifiers 11 and 13. L2 denotes the series inductance. Its value is much higher than that of the inductor L or L' in the Weber circuit: 100 to 1000 times higher.

In saturated mode, an inductor behaves like an inductor in air (without magnetic material). The inductor $L2_2$ acts in the present case like an automatic switch. Before saturation, very little current flows through it and, after saturation, a high current flows through it. From now on in the description, L2 denotes both the inductive element L2 and the value of this inductance.

In non-saturated mode, the inductor L2 acts like an inductance of value $L2_2$ ($L2_1$ being very low compared with $L2_2$) and in saturated mode like an inductance of value $L2_1$ ($L2_2$ is close to 0). Operation in non-saturated or saturated mode depends on the current iL2 through L2.

Figure 6:
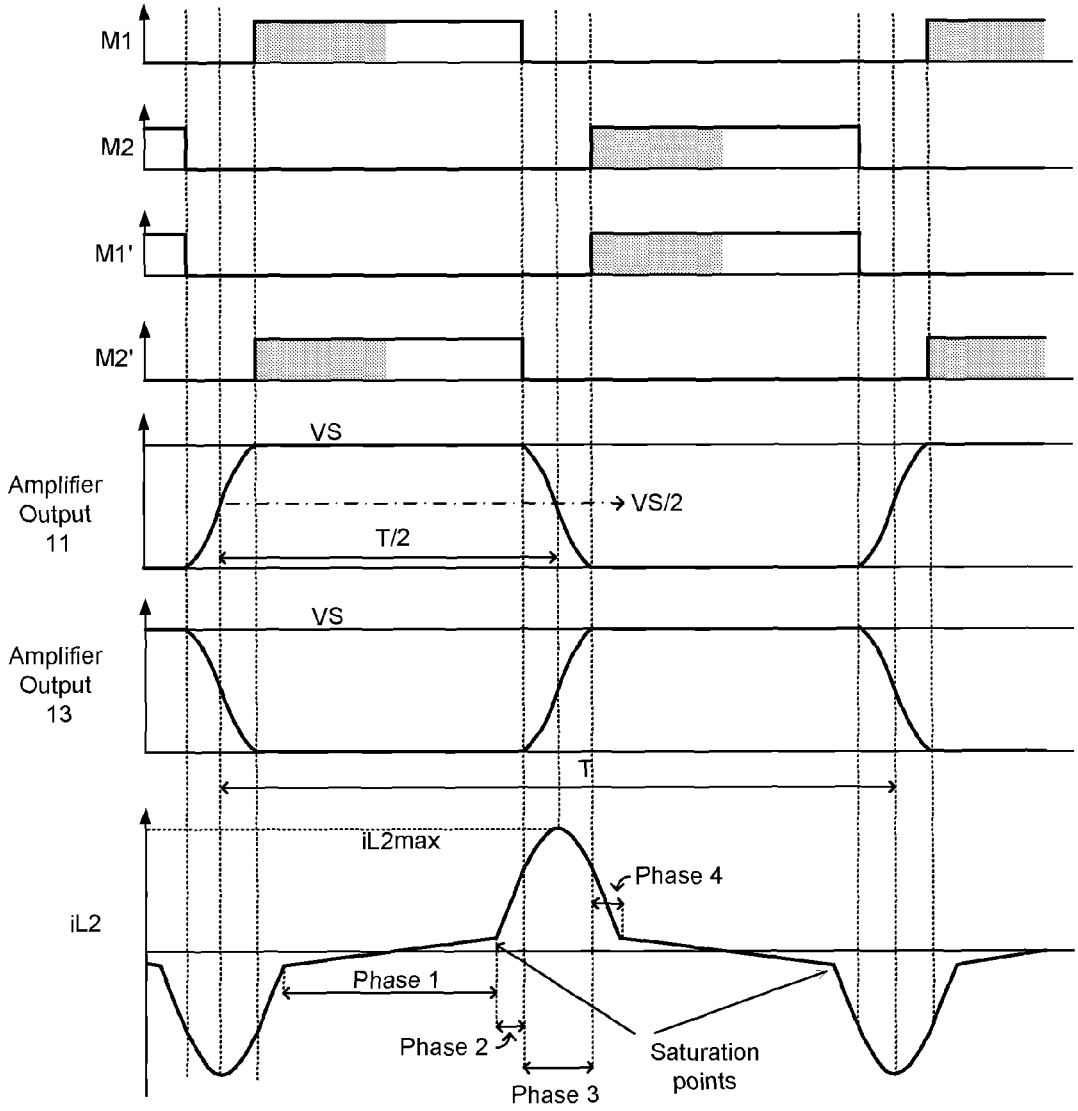
FIG. 6 shows timing diagrams illustrating the operation of the circuit of FIG. 5.

Operation of the amplifier in FIG. 5 is illustrated with reference to FIG. 6. FIG. 6 shows the control signals for the transistors M1, M2, M1' and M2', the voltage signal generated by the amplifiers 11 and 13 and the current iL2 through the inductors $L2_1$ and $L2_2$.

The operating half-period of the current iL2 is divided into four consecutive operating phases numbered 1 to 4.

During phase 1, the switches M1 and M2' are closed and the switches M2 and M1' are open. The output voltage of the amplifier 11 is equal to VS. Furthermore, being in a plateau phase of the electrode voltages, the transistors M6 and M8 are closed as in the previous embodiment. They ensure that the capacitor Cs is adequately charged from the source of power supplied by the AC/DC converter 1 and its output $V_{PFC}$. The output voltage of the amplifier 13 is equal to 0. The current flowing through the non-saturated inductor L2 is controlled by the higher-value inductor $L2_2$. Thus, the current flowing through the amplifiers 11 and 13 is much lower, which will result in reducing the conduction losses. The voltage across the terminals of the inductor L2 is substantially found across the terminals of the inductor $L2_2$.

At the start of phase 2, the inductor $L2_2$ saturates. The circuit is then controlled by the inductor $L2_1$. The current iL2 increases linearly as long as the switches M1 and M2' remain closed.

Phase 3 then starts when all the switches M1, M2, M1' and M2' are open. Moreover, being in a transition phase of the electrode voltages, the transistors M5 to M8 are open as in the previous embodiment. The inductor $L2_1$ then resonates with the capacitance Cp. The output voltage of the amplifier 11 starts to fall and that of the amplifier 13 starts to rise, both according to a sinusoidal segment. In the middle of phase 3, the voltage across the terminals of the inductor L2 is cancelled out before being reversed and the current flowing through it has its maximum amplitude before decreasing. At the end of this phase, the output voltage of the amplifier 11 reaches 0 volts (reference potential) and that of the amplifier 13 reaches VS.

At the start of phase 4, the current through the inductor L2 continues to fall linearly regardless of whether the switches M2 and M1' are in the open or closed state, because of their intrinsic diode (start of the greyed area). M2 and M1' must be closed before current becomes zero (end of the greyed area). At the end of this phase 4, the inductor $L2_2$ is no longer saturated. A phase that is symmetric to phase 1 then begins.

The choice of the inductor $L2_2$ is essential. Suitable magnetic material must be chosen and the number of turns required must be calculated. The number of turns of $L2_2$ can be defined as follows:

During each operating phase, for example during phase 1 in FIG. 6, $$V_{L2_2} = n \cdot A_e \cdot \frac{\Delta B}{\Delta t_{ph1}}$$

where:

$A_e$ is the effective cross-sectional area of the magnetic material;

$\Delta B$ is the variation in magnetic induction during this phase;

$\Delta t_{ph1}$ is the duration of phase 1.

During this phase, the voltage across the terminals of $L2_2$ is equal to VS and the magnetic induction varies between $+B_{sat}$ and $-B_{sat}$ (or vice versa), giving:

$$VS = n \cdot A_e \cdot \frac{2 \cdot B_{sat}}{\Delta t_{ph1}} \rightarrow \quad (1)$$

$$n = \frac{VS \cdot \Delta t_{ph1}}{2 \cdot B_{sat} \cdot A_e}$$

$B_{sat}$ and $A_e$ depend only on the magnetic material used. The number of turns of the inductor $L2_2$ is thus calculated using equation (1). When choosing the material, it must be ensured that the magnetization cycle is sufficiently rectangular in order that the saturation is not "soft" and that the current iL2 at the saturation points is low (in order to reduce the intensity of effective current). In addition, the area of this cycle must be small to prevent losses known as hysteresis losses.

Advantageously, the inductors $L2_1$ and $L2_2$ are produced in the same coil provided that the number of turns of the coil and the effective cross-sectional area of the magnetic material are adjusted as a consequence. For example, if the number of turns n calculated as described above is not suitable for the coil $L2_1$ which corresponds to the inductance of the inductor L2 when in saturated mode, it is possible to add a supplementary coil in series with L2. But it is also possible to re-adjust the number of turns n and the cross-sectional area $A_e$.

For example, if the number of turns n calculated for phase 1 is too large for the next phases, it is sufficient to reduce this number and consequently to increase the cross-sectional area $A_e$ so that equation 1 is still satisfied.

For example, if the number of turns calculated for phase 1 is 10 and if $L2_1$ is four times too high for phases 2, 3 and 4, it is sufficient to divide the number of turns n by 2 and to multiply the cross-sectional area $A_e$ by 2.

The invention claimed is:

1. Device for generating a rectangular sustain voltage between the line scanning electrodes and the line common electrodes of luminous cells in a plasma panel, said voltage being produced by applying a first rectangular sustain voltage signal to the line scanning electrode of the cells and a second rectangular sustain voltage signal to the line common electrode of the cells, wherein it includes a first sustain amplifier connected to the line scanning electrode of the cells to produce the transitions of the first sustain voltage signal, a second sustain amplifier connected to the line common electrode of the cells to produce the transitions of the second sustain voltage signal and an insulated voltage supply circuit connected to the line scanning electrodes and to the line common electrodes of the cells in order to hold the end-of-transition voltage on said line scanning electrodes and said line common electrodes.

2. Device according to claim 1, wherein the insulated voltage supply circuit includes a transformer, the secondary of which is connected via a first end to the line scanning electrode of the cells and via a second end to the line common electrode of the cells, and a device capable of delivering to the primary of said transformer, in addition to the signal transitions, voltages corresponding to the end-of-transition voltages divided by the transformation ratio of the transformer.

3. Device according to claim 2, wherein said first and second sustain amplifiers each include:

a half-bridge structure with two switches which is connected between a supply line and a reference line, the middle point of said structure of the first sustain amplifier being connected to said line scanning electrode of the cells and the middle point of said structure of the second sustain amplifier being connected to said line common electrode of the cells, and a circuit for implementing soft switching with energy recovery connected to said half-bridge structure.

4. Device according to claim 3, wherein a storage capacitor is connected between the supply line and the reference line.

5. Device according to claim 3, wherein said circuit for implementing soft switching with energy recovery includes an inductive element capable of operating in saturated mode connected between the middle points of the two half-bridge structures.

* * * * *